United States Patent [19]

Anderson

[11] Patent Number: 5,000,109

[45] Date of Patent: Mar. 19, 1991

[54] PYLON CLAMP

[75] Inventor: Ole N. Anderson, Highland, Mich.

[73] Assignee: Spray Marine, Inc., Highland, Mich.

[21] Appl. No.: 354,863

[22] Filed: May 22, 1989

[51] Int. Cl.[5] ..... B63B 21/56

[52] U.S. Cl. ..... 114/242; 114/250

[58] Field of Search ..... 114/250–253, 114/97, 98; 441/69; 248/74.1, 74.4, 218.4, 225.31, 230, 316.1, 316.6, 689; 403/191, 236, 385

[56] References Cited

U.S. PATENT DOCUMENTS

| | | | |
|---|---|---|---|
| 66,633 | 7/1867 | Robbins, Jr. | 114/98 |
| 1,254,883 | 1/1918 | Chilson | 403/191 |
| 4,480,577 | 11/1984 | Naypaver | 114/253 |

OTHER PUBLICATIONS

"The Water Skier", Jun. 1987, p. 11.

*Primary Examiner*—Joseph F. Peters, Jr.

*Assistant Examiner*—Jesüs D. Sotelo

*Attorney, Agent, or Firm*—Gifford, Groh, Sprinkle, Patmore and Anderson

[57] ABSTRACT

An improved pylon clamp for a boom assembly is disclosed for use in conjunction with a skiboat having a pylon. The clamp is attached to the pylon and supports a boom so that it extends laterally outwardly from the boat. The clamp includes a first portion adapted for connection with the pylon and a second portion adapted for connection with one end of the boom. The first clamp portion has a pair of arcuate legs with an inner surface which flatly abuts against the pylon and a threaded fastener which, upon tightening, compresses the arcuate legs together and clampingly engages the pylon. The second portion of the clamp includes a pair of spaced apart legs which are adapted to receive one end of the boom therebetween. A fastener extends through the spaced apart legs to secure the boom to the pylon clamp.

9 Claims, 1 Drawing Sheet

PYLON CLAMP

BACKGROUND OF THE INVENTION

I. Field of the Invention

The present invention relates to a pylon clamp for a boom assembly for use with a boat having a pylon.

II. Description of the Prior Art

Most skiboats of the type used for waterskiing include a generally cylindrical pylon which is mounted near the center of the boat so that the pylon extends substantially vertically. The outer periphery of the pylon is typically cylindrical in shape although an enlarged diameter cap is oftentimes provided at the top of the pylon. In use, the ropes from the waterskier are tied directly to the pylon.

Although many waterskiers ski behind these skiboats, many waterskiers, and particularly "barefoot" waterskiers, utilize a boom which extends laterally outwardly to one side of the skiboat. One end of the boom is secured to the pylon by a clamp while the waterskier or barefoot skier holds on to a tow bar secured to the other or outer end of the boom. Such a boom is particularly advantageous for barefoot waterskiers since the waterskier skis in front of the wake created by the boat.

One type of previously known clamp used to secure the inner end of the boom to the pylon comprises two spaced apart plates each of which has an arcuate surface adapted to engage opposite sides of the pylon. The plates are secured to the pylon so that these arcuate surfaces clamp against the pylon. The inner end of the boom is then secured between the plates by a conventional fastener.

These previously known pylon clamps, however, have not proven wholly satisfactory in use. One disadvantage of these previously known pylon clamps is that the clamps become cocked with respect to each other. This, in turn, can result in difficulty in removing and installing the boom assembly.

A still further disadvantage of this previously known pylon clamp is that the pylon clamps are machined from bar stock to form the arcuate surfaces. Such machining is expensive not only in labor costs, but also material costs since the machined portion of the bar stock is simply discarded.

A still further disadvantage of this previously known pylon clamp is that only a relatively small surface actually abuts against the pylon once the clamp is secured to the pylon. This, in turn, can result in undesirable slippage of the clamp during use.

Lastly, because these previously known multipiece clamps are relatively difficult to simultaneously attach to the pylon and also to the inner end of the boom.

SUMMARY OF THE PRESENT INVENTION

The present invention provides a pylon clamp for a boom assembly which overcomes all of the above mentioned disadvantages of the previously known pylon clamps.

In brief, the pylon clamp of the present invention comprises a first portion which is adapted for connection to the pylon and a second portion which is adapted for connection to the boom. The first clamp portion comprises a pair of arcuate legs which have an inner surface which are adapted to flatly abut against the pylon. A threaded fastener extends through outwardly protruding tabs at the free ends of each arcuate leg so that, upon tightening of the fastener, the arcuate legs compress and flex together and thus clampingly engage the pylon in the desired fashion.

The second portion of the pylon clamp comprises a pair of spaced apart and generally parallel straight legs. These straight legs are dimensioned to receive the inner end of the boom therebetween. A fastener then extends through the straight legs and the inner end of the boom to secure the inner end of the boom to the pylon clamp.

The second portion of the clamp and at least a part of the first portion of the pylon clamp are of a one-piece construction. Consequently, the distance or spacing between the flat legs adapted to receive the inner end of the boom is fixed thereby completely eliminating any possible difficulty of boom installation as has occurred with the previously known pylon clamps. Furthermore, since the arcuate legs extend substantially entirely around the pylon except for a small spacing between the tabs, a much greater area of contact between the clamp and the pylon is achieved than with the previously known pylon clamps.

In a preferred form of the invention, the pylon clamp is formed from an extrusion. As such, machining of the pylon clamp is greatly minimized.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
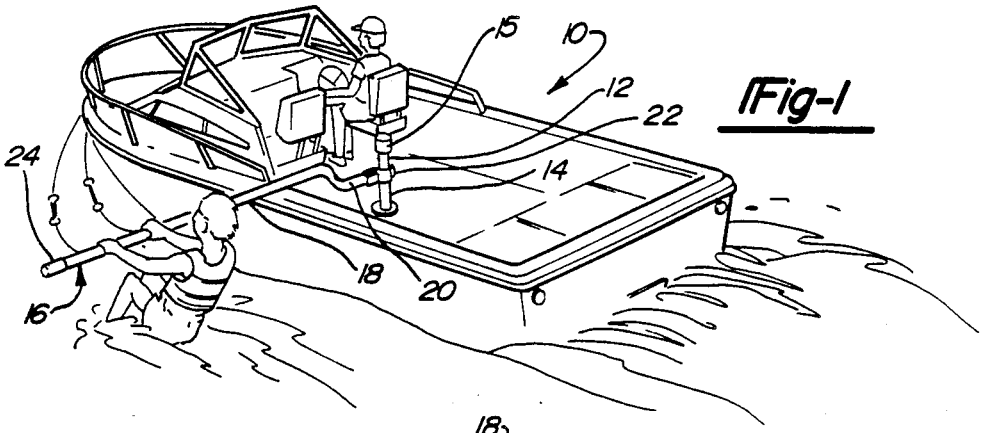
FIG. 1 is a perspective view illustrating a preferred embodiment of the present invention.

With reference first to FIG. 1, a skiboat 10 of the type to pull waterskiers or "barefooters" is thereshown having a pylon 12 extending generally vertically upwardly in the boat near its center. In the well known fashion, the pylon 12 includes a generally cylindrical outer periphery 14 but may also have an enlarged diameter cap 15 at its top.

Still referring to FIG. 1, the present invention comprises a boom assembly 16 having an elongated boom 18 mounted at an inner end 20 to the pylon 12 by a pylon clamp 22 in a fashion which will be subsequently described in greater detail. The outer or free end 24 of the boom 18 extends generally laterally outwardly from the boat 10 for pulling a waterskier or barefooter. Since the boom 18 extends laterally outwardly to one side of the boat 10, the waterskier towed by the boom assembly 16 is in front of the wake created by the boat 10 as it travels through the water.

Figure 2:
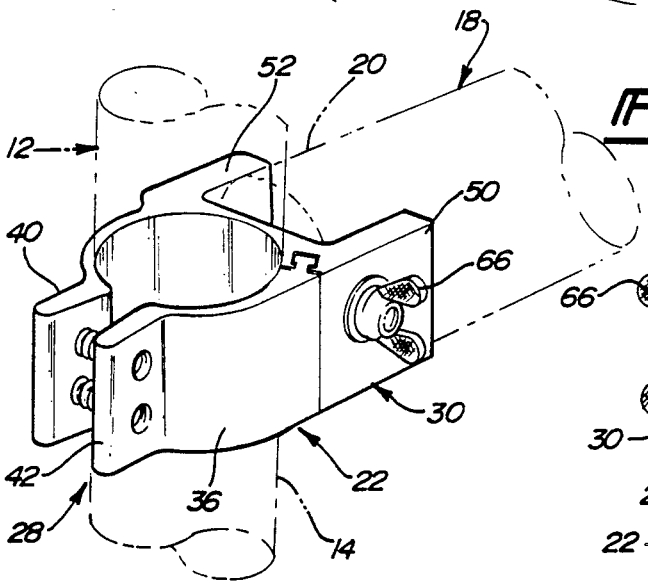
FIG. 2 is a fragmentary perspective view illustrating the preferred form of the pylon clamp of the present invention.
Figure 3:
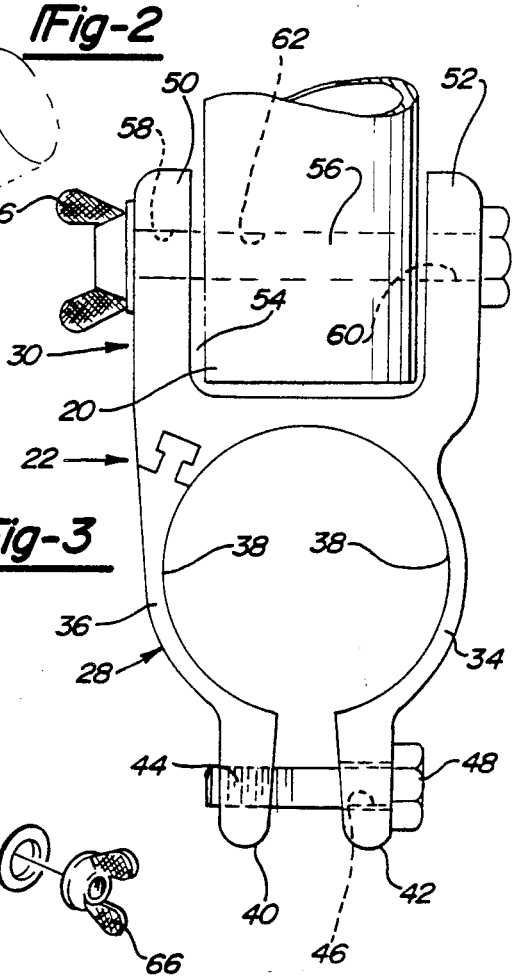
FIG. 3 is a top view illustrating a preferred embodiment of the pylon clamp of the present invention.

With reference now to FIGS. 2 and 3, the pylon clamp 22 is thereshown in greater detail and comprises a first portion 28 adapted for connection with the pylon 12 and a second portion 30 adapted for connection to the inner end 20 of the boom 18. The first portion 28 of the pylon clamp includes a pair of arcuate legs 34 and 36 each having a cylindrical inner periphery 38 adapted to flatly abut against the outer periphery 14 of the pylon 12. Small tabs 40 and 42 extend radially outwardly from a free end of each leg 34 and 36, respectively, so that the tabs 40 and 42 are spaced apart from each other by a small amount. Otherwise, however, the inner cylindrical periphery 38 of the arcuate legs 34 and 36 extend continuously around the pylon 12.

The tabs 40 and 42 each include registering bores 44 and 46, respectively. One bore 44 is preferably internally threaded and is adapted to threadably engage a threaded fastener 48 positioned through the opposite bore 46 on the tab 40.

With the first portion 28 of the pylon clamp 22 positioned over the pylon 12, upon tightening the fastener 48, the arcuate legs 34 and 36 are compressed and flex together to thereby clampingly engage the pylon 12.

Still referring to FIGS. 2 and 3, the second portion 30 of the pylon clamp 22 comprises a pair of spaced apart straight legs 50 and 52 which, together, form a generally U-shaped channel 54. The inner end 20 of the boom 18 is adapted to be positioned within the U-shaped channel 54. Thereafter, a threaded fastener 56 extends through registering bores 58 and 60 on the legs 50 and 52, as well as a registering bore 62 in the inner end 20 of the boom 18, to thereby secure the boom 18 to clamp 28. The threaded fastener 56 is preferably a bolt which threadably cooperates with a nut 66 although, alternatively, one of the bores 58 or 60 can be internally threaded to threadably receive the bolt 56.

As best shown in FIG. 3, both legs 50 and 52 of a second portion 30 of the pylon clamp 22, as well as at least one leg 36 of the first portion of the pylon clamp are of a one-piece construction. Consequently, the distance between the straight legs 50 and 52 is fixed thereby effectively eliminating any chance of difficulty of installing the boom 18 as has occurred with the previously known clamps. Furthermore, preferably the second portion 30 of the clamp 22 as well as at least one leg 34 of the first portion 28 of the pylon clamp 22 is formed from an extrusion thereby minimizing machining of the pylon clamp 22.

Figure 4:
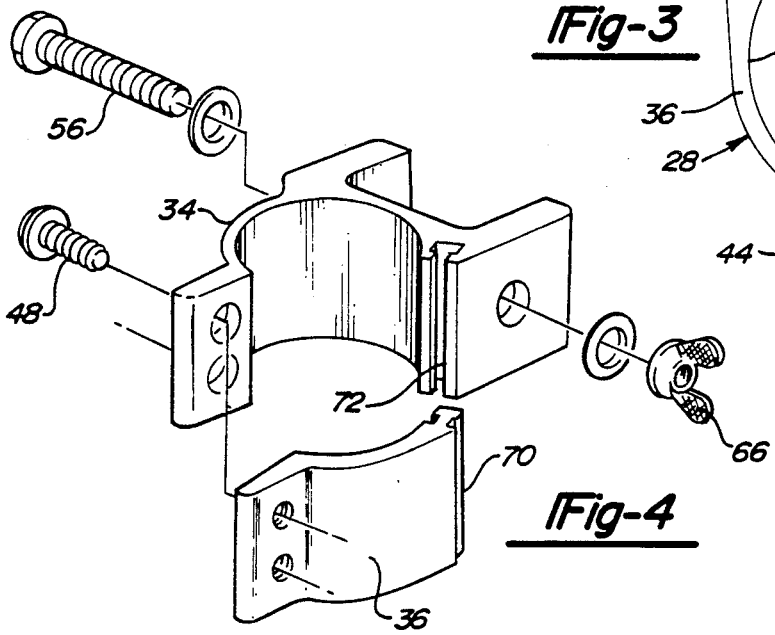
FIG. 4 is an exploded view of the pylon clamp of the present invention.

With reference now particularly to FIG. 4, although the arcuate legs 34 and 36 of the first portion 28 of the pylon clamp 22 can be of a one-piece construction, in the preferred embodiment of the invention, the arcuate leg 36 includes a T-shaped projection 70 at one end which is slidably received within a T-shaped slot 72 on the clamp 22. Thus, the leg 34 can be removed from the remainder of the clamp 22 which may be required in order to position the arcuate legs 34 and 36 around the pylon 12 in the event of an obstruction or enlarged diameter cap 15 (FIG. 1) at the top of the pylon 12.

From the foregoing, it can be seen that the present invention provided a simple, inexpensive and yet totally effective pylon clamp for a boom assembly.

Having described my invention, however, many modifications thereto will become apparent to those skilled in the art to which it pertains without deviation from the spirit of the invention as defined by the scope of the appended claims.

I claim:

1. For use in conjunction with a boat having a substantially cylindrical pylon, a pylon clamp for attachment to an elongated boom of a boom assembly, said clamp comprising:

a first portion adapted for connection with the pylon and a second portion adapted for connection with one end of the boom, said first clamp portion further comprising a pair of arcuate legs and means for compressing said arcuate legs toward each other, wherein said arcuate legs have an inner surface which flatly abuts against the pylon as said arcuate legs are compressed toward each other, said second clamp portion comprising a pair of spaced apart legs adapted to receive said one end of said boom therebetween, said legs being spaced apart from each other by a preset, fixed amount, and means for fastening said one end of said boom to said second clamp portion, wherein said second clamp portion is a one piece construction.

2. The invention as defined in claim 1 wherein said second clamp portion and at least one of said arcuate legs is of a one piece construction.

3. The invention as defined in claim 2 wherein said second clamp portion and said at least one arcuate leg is an extrusion.

4. The invention as defined in claim 3 wherein said clamp is made of aluminum.

5. The invention as defined in claim 1 and comprising means for detachably securing a part of one arcuate leg to said clamp.

6. The invention as defined in claim 5 wherein said detachable securing means comprises a T-slot connection between said part of said arcuate leg and said clamp.

7. For use in conjunction with a boat having a substantially cylindrical pylon, a pylon clamp for attachment to an elongated boom of a boom assembly, said clamp comprising:

a first portion adapted for connection with the pylon and a second portion adapted for connection with one end of the boom, said first clamp portion further comprising a pair of arcuate legs and means for compressing said arcuate legs toward each other, wherein said arcuate legs have an inner surface which flatly abuts against the pylon as said arcuate legs are compressed toward each other, said second clamp portion comprising a pair of spaced apart legs adapted to receive said one end of said boom therebetween, said legs being spaced apart from each other by a preset, fixed amount, and means for fastening said one end of said boom to said second clamp portion, wherein said second clamp portion and at least one of said arcuate legs is of a one piece construction.

8. The invention as defined in claim 7 and comprising means for detachably securing a part of one arcuate leg to said clamp.

9. The invention as defined in claim 8 wherein said detachable securing means comprises a T-slot connection between said part of said arcuate leg and said clamp.

* * * * *